United States Patent [19]

Douda et al.

[11] 4,032,374

[45] June 28, 1977

[54] CINNAMIC ACID CONTAINING PYROTECHNIC SMOKE COMPOSITION

[75] Inventors: Bernard E. Douda, Bloomfield; John E. Tanner, Jr., Bloomington, both of Ind.

[73] Assignee: The United States of America as represented by the Secretary of the Navy, Washington, D.C.

[22] Filed: Sept. 22, 1976

[21] Appl. No.: 725,606

[52] U.S. Cl. ..... 149/19.8; 102/90; 149/19.1; 149/78; 149/83; 149/84; 149/85; 149/117; 252/305

[51] Int. Cl.[2] ..... C06B 45/10

[58] Field of Search ..... 149/19.1, 19.8, 79, 149/83, 84, 85, 117; 102/90; 252/305

[56] References Cited

UNITED STATES PATENTS

| | | | |
|---|---|---|---|
| 2,411,070 | 11/1946 | Van Karner | 149/84 |
| 3,690,971 | 9/1972 | Gunderloy et al. | 149/84 X |
| 3,695,949 | 10/1972 | Freeman et al. | 149/84 X |
| 3,802,971 | 4/1974 | Burkardt et al. | 149/79 X |
| 3,960,087 | 6/1976 | Beatty et al. | 149/85 X |
| 4,007,690 | 2/1977 | Wildridge | 102/90 X |

*Primary Examiner*—Edward A. Miller
*Attorney, Agent, or Firm*—R. S. Sciascia; Paul S. Collignon

[57] ABSTRACT

A non-toxic smoke composition for use in simulating fires in damage control exercises and for use in training. Transcinnamic acid is used as the smoke producing agent and is volatilized by energy from a potassium chlorate/sugar mixture which provides a low burning temperature.

5 Claims, No Drawings

CINNAMIC ACID CONTAINING PYROTECHNIC SMOKE COMPOSITION

BACKGROUND OF THE INVENTION

The present invention relates to a smoke composition, and more particularly to a non-toxic smoke composition which can be used to simulate fires for training purposes.

Various devices and compositions are presently used to simulate a fire for training purposes. For examples, one such device currently in use by the Navy for training of personnel in fire fighting procedures and the use of gas masks resembles a hand grenade. A grenade igniting fuze is fitted in a cylindrical metal body and a quantity of oil is provided in an upper chamber and a fuel mixture is provided in the base. A venturi tube extends from directly above the fuel mixture through the oil chamber to the top of the pot. There are small openings, each sealed with low-melting-point solder, in the venturi tube; one into the oil chamber, the other into the space above the oil surface. There are three tape-covered holes in the top of the pot. When the fuze ignition mixture ignites the starter mixture at the lower end of the venturi tube, the fuel mixture starts burning. Heat melts the solder in the venturi tube openings and the oil flows into the venturi tube where it is vaporized. This vapor passes upward and emits through the vent holes in the top of the smoke pot. Upon emission, it condenses to form a dense white cloud.

One disadvantage of the grenade-type smoke pot is that personnel are required to be in respiratory protective devices prior to commencing a fire drill and thus the value of the smoke for realistic training is greatly reduced. Additionally, such devices cannot be used aboard submarines operating submerged due to the toxic affect of the smoke.

SUMMARY OF THE INVENTION

The present invention relates to a non-toxic smoke composition wherein trans-cinnamic acid is used as the smoke-producing agent. The trans-cinnamic acid is volatilized by burning a potassium chlorate/sugar mixture. In the preferred embodiment, a small amount of sodium bicarbonate is added as a cooling agent, diatomite silica is added as a filler and nitrocellulose is added as a binder.

It is therefore a general object of the present invention to provide a smoke composition for use in simulating fires for training purposes.

Other objects, advantages and novel features of the invention will become apparent from the following detailed description of the invention.

DESCRIPTION OF THE PREFERRED EMBODIMENT

A non-toxic smoke composition is provided which utilizes trans-cinnamic acid as the smoke producing agent. Pyrotechnic volatilization of trans-cinnamic acid is accomplished by burning a potassium chlorate/sugar mixture.

Trans-cinnamic acid, also known as trans-B-phenylacrylic acid, is a white crystalline solid which has a melting point of 135° C. and a normal boiling point of 300° C.

The decomposition temperatures of various mixtures of sugar, trans-cinnamic acid and potassium chlorate were determined by differential thermal analysis and are shown in the following TABLE I, wherein approximately equal portions of each ingredient were used.

TABLE I (Temperature of Exothermic Decomposition by Differential Thermal Analysis)

| COMPOSITION | TEMPERATURE |
|---|---|
| Sucrose/$KClO_3$ | 140° C. |
| Lactose/$KClO_3$ | 190° C. |
| Trans-Cinnamic Acid/$KClO_3$ | 260° C. |
| $KClO_3$ | 370° C. |
| Trans-Cinnamic Acid/Sucrose/$KClO_3$ | 170° C. |
| Trans-Cinnamic Acid/Lactose/$KClO_3$ | 210° C. |

As can be seen from TABLE I, sucrose decomposes at a lower temperature than lactose and thus would be preferably for the volatilization of trans-cinnamic acid. Also, the fact that the decomposition of trans-cinnamic acid by potassium chlorate occurs at a higher temperature than the decomposition of the sugar, shows that it is possible to vaporize the trans-cinnamic acid without decomposition, by means of the combustion of sugar.

The following examples will illustrate the preferred embodiments of the invention wherein parts and percentages are by weight unless otherwise specified.

EXAMPLE I

| | |
|---|---|
| Trans-Cinnamic Acid | 47.5 |
| Sucrose | 12.0 |
| Potassium chlorate | 29.0 |
| Sodium bicarbonate | 6.5 |
| Diatomite Silica | 5.0 |

The trans-cinnamic acid, sucrose, potassium chlorate and sodium bicarbonate were mixed dry and then enough cellulose nitrate was added as a 40 percent solution in acetone to make the mixture stiff, but not visibly wet or pasty. It is estimated that the amount of dry cellulose nitrate so added equaled 2 to 5 percent of the total weight of composition. As the cellulose nitrate is used for a binder, its exact weight is not critical to the formula.

The mixture was air dried for about an hour until the smell of acetone was nearly gone and the mixture was then crushed to a powder and the diatomite silica was added. The mixture was then lightly tamped by hand into a fish paper tube having an internal diameter of 33 mm. A layer of first fire composition was placed on one end of the candle to facilitate ignition. The first fire composition used is described in MIL-STD-720, and consists of 50 percent of barium nitrate, 20 percent of silicon, 10 percent of tetranitrocarbazole, 15 percent of zirconium hydride and 5 percent of a binder solution.

The candle was ignited by the first fire and, after ignition, the flame was extinguished and the candle continued to smoke without again bursting into flame. The candle burned to completion at a somewhat irregular rate leaving a case filled with a fluffy black powder. The total weight of the candle was 32g. and the weight of the ash was 8g. The smoke produced was of moderately good volume.

EXAMPLE II

| | |
|---|---|
| Trans-Cinnamic Acid | 48.0 |
| Sucrose | 12.5 |
| Potassium chlorate | 28.5 |
| Sodium bicarbonate | 6.5 |

EXAMPLE II-continued

| | |
|---|---|
| Diatomite silica | 4.5 |

The ingredients were mixed and a candle was made as described in EXAMPLE I. A layer of first fire composition was added and the candle burned as in EXAMPLE I. The total weight of the candle was 42g. and the weight of the ash was 9g. The candle burned for 1.5 minutes and the smoke produced was of moderately good volume.

EXAMPLE III

| | |
|---|---|
| Trans-Cinnamic Acid | 58.0 |
| Sucrose | 10.0 |
| Potassium chlorate | 23.0 |
| Sodium bicarbonate | 5.5 |
| Diatomite silica | 3.5 |

The ingredients were mixed and a candle was made as described in EXAMPLE I. A layer of first fire composition was added and the candle burned as in EXAMPLE I. The candle burned for 3 minutes and the smoke produced was of moderately good volume.

EXAMPLE IV

| | |
|---|---|
| Trans-Cinnamic Acid | 45.5 |
| Sucrose | 12.0 |
| Potassium chlorate | 27.5 |
| Sodium bicarbonate | 10.5 |
| Diatomite silica | 4.5 |

The ingredients were mixed and a candle was made and burned as described in EXAMPLE I. The candle burned for 3.5 minutes and the smoke produced was of moderately good volume.

EXAMPLE V

| | |
|---|---|
| Trans-Cinnamic Acid | 75.5 |
| Sucrose | 5.5 |
| Potassium chlorate | 13.0 |
| Sodium bicarbonate | 4.0 |

EXAMPLE V-continued

| | |
|---|---|
| Diatomite silica | 2.0 |

The ingredients were mixed as described in EXAMPLE I and a candle was made with a hollow core of 6.4 mm. The hollow core was filled with a first fire composition and ignited. The candle smoked intensely for 15 seconds and then died down and went out. A thin layer of melted, rehardened material covered the lower half of the candle.

It will now be readily apparent that the present invention provides a pyrotechnic smoke composition which can be used to simulate fires for training personnel in fire fighting techniques.

Obviously many modifications and variations of the present invention are possible in the light of the above teachings. It is therefore to be understood that the invention may be practiced otherwise than as specifically described.

We claim:

1. A non-toxic smoke composition comprised, by weight, of between 45.5 parts and 75.5 parts of cinnamic acid,
between 5.5 parts and 12.5 parts of sugar,
between 13 parts and 29 parts of potassium chlorate,
between 4 parts and 10.5 parts of sodium bicarbonate,
between 2 parts and 5 parts of diatomite silica, and
between 2 parts and 5 parts of a binder.

2. A non-toxic smoke composition as set forth in claim 1 wherein said sugar is sucrose.

3. A non-toxic smoke compostion as set forth in claim 1 wherein said sugar is lactose.

4. A non-toxic smoke composition as set forth in claim 1 wherein said binder is nitrocellulose.

5. A non-toxic smoke composition comprised, by weight, of about 48 parts of cinnamic acid,
about 12 parts of sucrose,
about 29 parts of potassium chlorate,
about 7 parts of sodium bicarbonate,
about 4 parts of diatomite silica, and
between 2 and 5 parts of nitrocellulose.

* * * * *